US007707781B2

(12) United States Patent
Van Cleave et al.

(10) Patent No.: US 7,707,781 B2
(45) Date of Patent: May 4, 2010

(54) GUTTER CAP ASSEMBLY AND BRACKET

(75) Inventors: Jeffrey Van Cleave, Troy, MI (US); Eugene G. Eichhorn, Pinckney, MI (US); Matthew S. Damron, Ypsilanti, MI (US); Joseph W. Pawlow, Redford, MI (US)

(73) Assignee: Van Mark Products Corporation, Farmington Hills, MI (US)

( * ) Notice: Subject to any disclaimer, the term of this patent is extended or adjusted under 35 U.S.C. 154(b) by 0 days.

(21) Appl. No.: 12/400,082

(22) Filed: Mar. 9, 2009

(65) Prior Publication Data

US 2009/0165398 A1 Jul. 2, 2009

Related U.S. Application Data

(63) Continuation of application No. 11/064,604, filed on Feb. 24, 2005, now Pat. No. 7,500,375.

(51) Int. Cl.
*E04D 13/00* (2006.01)
*E04D 13/08* (2006.01)

(52) U.S. Cl. ..... 52/11; 52/12; 52/14; 52/16

(58) Field of Classification Search ..... 52/11, 52/12, 14, 16
See application file for complete search history.

(56) References Cited

U.S. PATENT DOCUMENTS

| | | | | |
|---|---|---|---|---|
| 0,040,951 | A | 12/1863 | Scofield et al. | |
| 0,476,299 | A | 5/1892 | Coiling | |
| 891,406 | A * | 6/1908 | Cassens | 210/542 |
| 1,636,744 | A | 7/1927 | Johanson | |
| 2,144,663 | A * | 1/1939 | Petersen | 248/48.1 |
| 2,907,366 | A | 10/1959 | Wilson | |
| 3,043,360 | A | 7/1962 | Hutchison | |
| 3,906,784 | A | 9/1975 | Coulstring | |
| 4,133,197 | A | 1/1979 | Allen | |
| 4,404,775 | A | 9/1983 | Demartini | |
| 4,467,633 | A | 8/1984 | McEwen et al. | |
| 4,497,146 | A | 2/1985 | Demartini | |
| 4,796,390 | A | 1/1989 | Demartini | |
| 5,040,750 | A * | 8/1991 | Brant | 248/48.2 |
| 5,333,417 | A | 8/1994 | Demartini | |
| 5,388,377 | A * | 2/1995 | Faulkner | 52/11 |
| 5,845,435 | A * | 12/1998 | Knudson | 52/11 |
| 5,878,533 | A * | 3/1999 | Swanfeld, Jr. | 52/11 |
| 6,003,357 | A | 12/1999 | Brown | |
| 6,016,631 | A * | 1/2000 | Lowrie, III | 52/12 |
| 6,098,345 | A | 8/2000 | Demartini et al. | |
| 6,308,464 | B1 | 10/2001 | Demartini | |

(Continued)

OTHER PUBLICATIONS

Gutter Wizards, Circle 160, Qualified Remodeler, Aug. 200, p. 1.

*Primary Examiner*—Richard E Chilcot, Jr.
*Assistant Examiner*—Mark R Wendell
(74) *Attorney, Agent, or Firm*—Brooks Kushman P.C.

(57) ABSTRACT

A gutter cap forming tool is provided for use in a method of forming a gutter cap from a sheet stock blank. A roll forming operation is performed to form a reversely-turned arcuate bend in the gutter cap. The gutter cap assembly includes a gutter cap and a bracket that secures the gutter cap to a building and a gutter.

14 Claims, 7 Drawing Sheets

U.S. PATENT DOCUMENTS

| | | | | |
|---|---|---|---|---|
| 6,367,743 | B1 * | 4/2002 | Iannelli | 248/48.2 |
| 6,543,729 | B1 * | 4/2003 | Ylonen | 248/48.1 |
| 6,631,587 | B2 * | 10/2003 | Lynch | 52/11 |
| 6,658,796 | B1 * | 12/2003 | Higgins | 52/11 |
| 6,701,674 | B1 * | 3/2004 | Albracht | 52/12 |
| 6,708,452 | B1 * | 3/2004 | Tenute | 52/11 |
| 6,732,477 | B1 * | 5/2004 | Richard | 52/12 |
| 6,959,512 | B2 * | 11/2005 | Cobb | 52/12 |
| 6,993,870 | B2 * | 2/2006 | McDonald et al. | 52/11 |
| 2002/0073631 | A1 * | 6/2002 | Baker | 52/12 |
| 2003/0009951 | A1 * | 1/2003 | Bergeron | 52/12 |
| 2004/0000098 | A1 * | 1/2004 | Knudson | 52/12 |
| 2004/0244304 | A1 * | 12/2004 | Bullinger | 52/12 |
| 2004/0250478 | A1 * | 12/2004 | McDonald et al. | 52/11 |
| 2005/0166466 | A1 * | 8/2005 | Cobb | 52/11 |
| 2005/0172566 | A1 * | 8/2005 | McDonald et al. | 52/12 |
| 2006/0000154 | A1 * | 1/2006 | Wirbel | 52/12 |
| 2006/0080898 | A1 * | 4/2006 | Brown | 52/11 |
| 2006/0185259 | A1 | 8/2006 | Cleave et al. | |
| 2008/0120921 | A1 * | 5/2008 | McDonald et al. | 52/12 |

* cited by examiner

Fig. 4.
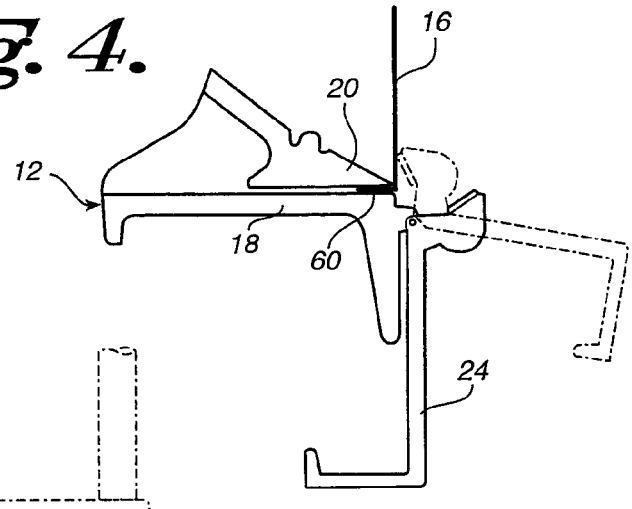
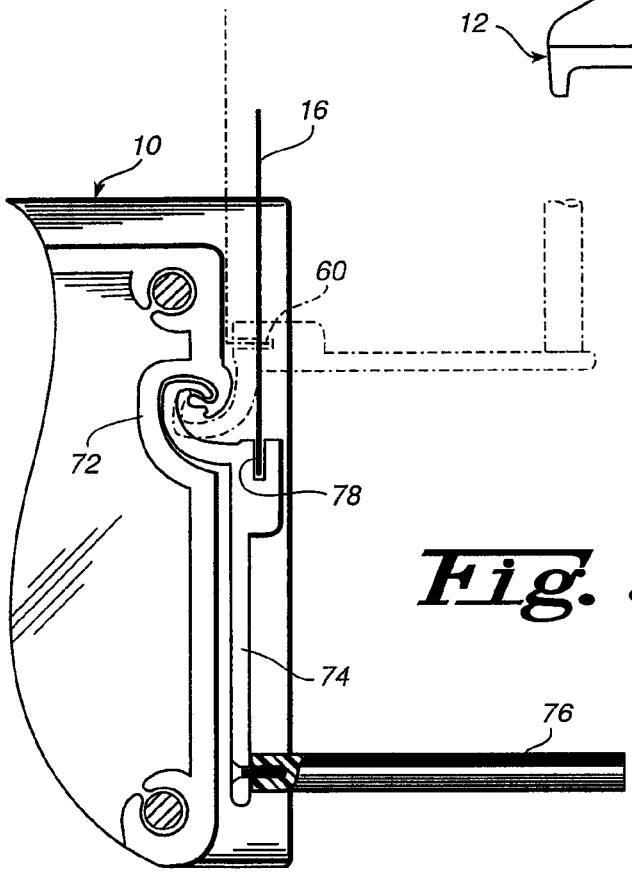
Fig. 5.
Fig. 6.
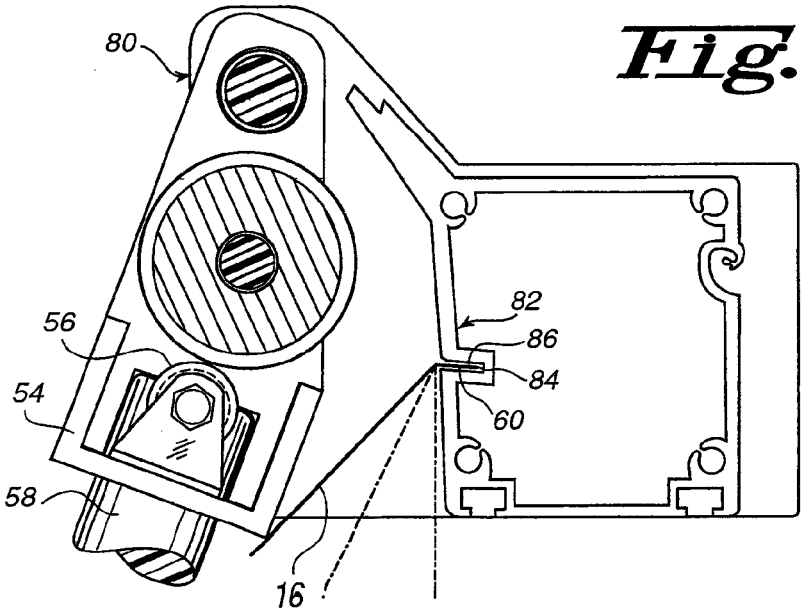

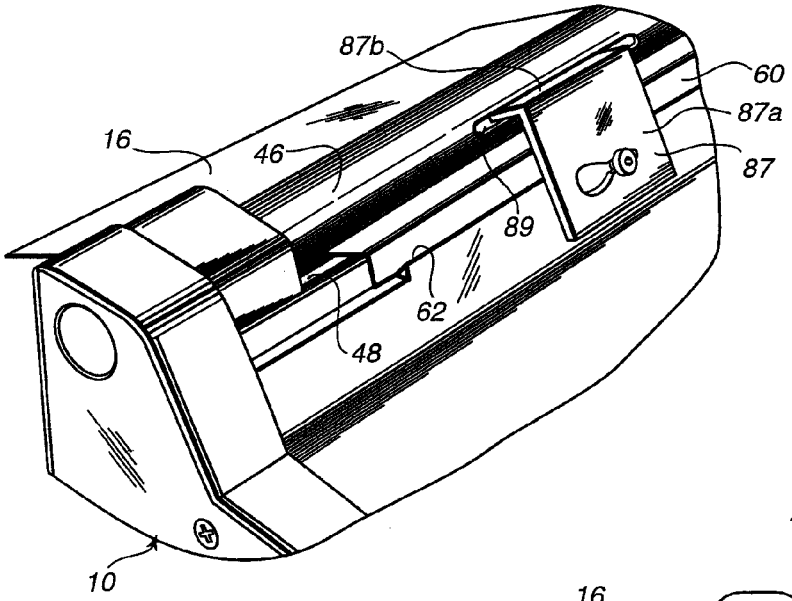
Fig. 7.
Fig. 8.
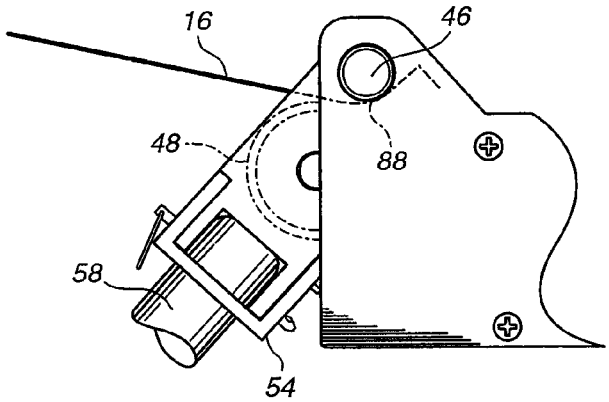
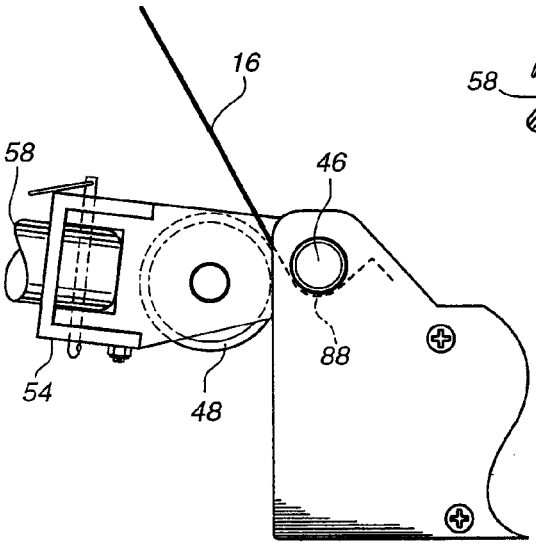
Fig. 9.
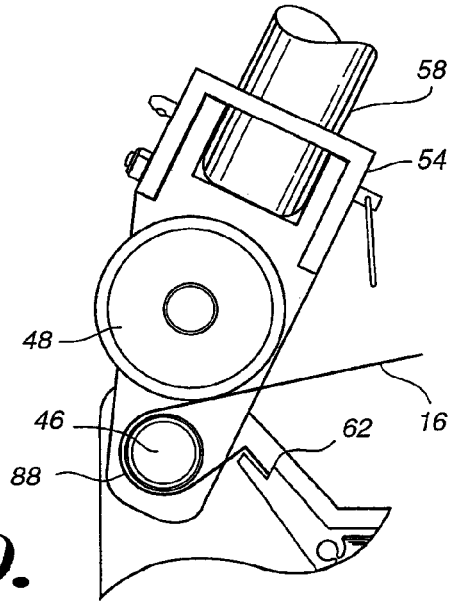
Fig. 10.

Fig. 11.
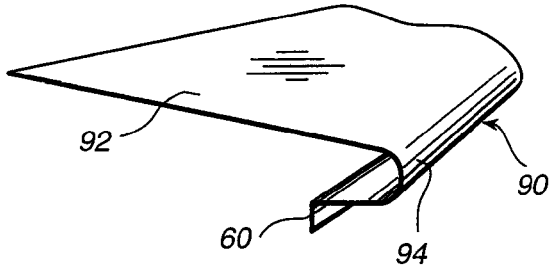
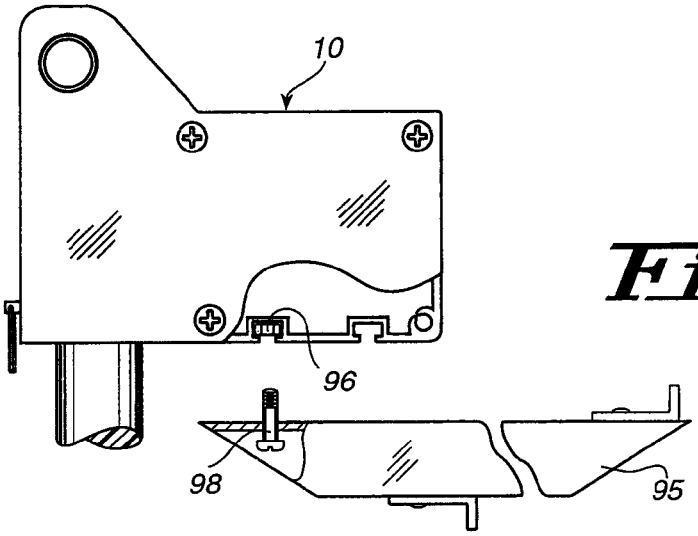
Fig. 12.
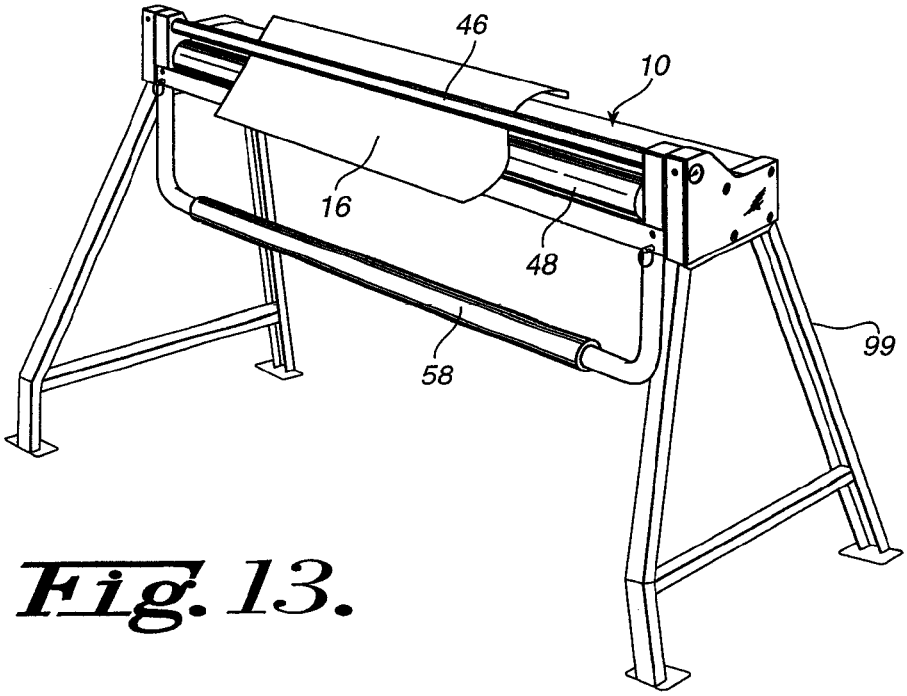
Fig. 13.

GUTTER CAP ASSEMBLY AND BRACKET

CROSS-REFERENCE TO RELATED APPLICATIONS

This application is a continuation of U.S. application Ser. No. 11/064,604 filed Feb. 24, 2005, now U.S. Pat. No. 7,500,375.

BACKGROUND OF THE INVENTION

1. Field of the Invention

The present invention relates to a gutter cap, a gutter cap bracket and a gutter cap forming tool that may be used to make a gutter cap assembly.

2. Background Art

Gutters are provided on houses and other buildings to collect rain water flowing off of a roof and direct the water to down spouts that in turn direct the water away from the foundation of the house or building. While gutters perform a valuable function, the effectiveness of gutters is adversely affected by the accumulation of debris in the gutters. The flow of water in gutters may be blocked by an accumulation of debris that may form a dam preventing water from flowing through the gutters to the down spout. Gutters may overflow if the water is prevented from flowing through the gutter. Water flowing off of the roof that overflows the gutters defeats the purpose of the gutters. Debris in gutters can also lead to the formation of ice dams on the roof that can damage the roof of the building.

Cleaning gutters is a difficult and sometimes dangerous chore. A person generally must use a ladder to reach a clogged gutter to manually remove debris. Debris such as leaves, seeds, pine needles, twigs and other material may fall on a roof and may be washed into the gutters where it may accumulate. While hand tools and hose attachments have been developed to make the process of cleaning gutters less difficult, this is one chore that homeowners would rather avoid.

Gutter caps have been developed that cover the top of a gutter to prevent debris from being deposited in the gutter. Gutter caps allow water to flow around an arcuate flow path to the underside of the gutter cap as a result of the surface tension of the water.

One problem associated with gutter caps is that they are generally fabricated off-site in a factory and shipped in predetermined lengths to a job site where they are cut and assembled. Prefabricated gutter caps are relatively costly. There is a need for a gutter cap that may be made to custom sizes without unnecessary scrap or waste that is associated with gutter caps that are provided in predetermined lengths.

Prefabricated gutter caps are generally only available in aluminum and in a limited number of colors. There is a need for a tool for forming gutter caps on site that may be made of a variety of different materials and may be provided in a wide range of colors to match the wide range of aluminum and vinyl siding colors that are currently available.

Gutter caps that are currently available generally require that the gutter be removed and replaced at a lower height on the house or building to provide the proper pitch for the gutter cap so that the water may flow down the roof, across the gutter cap and into the gutter while preventing debris from entering the gutter. In addition, prefabricated gutter caps tend to be difficult to install because it is hard to hold a long length of gutter cap material in place while it is being secured to a gutter on a building.

Installation systems used with prior art gutter caps generally require brackets that may cause the gutter cap to interfere with gutter spikes that are used to secure the gutter to a building. Generally, the brackets for a gutter cap are independent from other gutter mounting hardware such as gutter spikes and sleeves. Frequently, gutter caps must be notched to accommodate gutter spikes and sleeves. There is a need for gutter cap assembly system that may be used without interfering with gutter spikes and sleeves while providing a simple installation procedure.

Prior art brackets generally have fastener receptacle holes that are difficult to locate while standing on a ladder and working in the limited space provided between the gutter and gutter cap. There is a need for a bracket that is easy to install and constrains the gutter cap with or without a fastener.

Recently, a gutter cap forming tool known as the Gutter Wizard® was developed that is currently being offered at the website "BuildingSolution.com". The Gutter Wizard® product is an on-site gutter cap fabrication tool. While the ability to provide an on-site gutter fabricating tool offers certain advantages, the Gutter Wizard® tool requires that a flange be formed in a sheet stock blank using a separate bending brake tool. The flange is inserted lengthwise into an L-shaped longitudinally extending slot in the Gutter Wizard® tool. The Gutter Wizard® tool tends to be difficult to use because it is difficult to slide the flange, full length, into the tool. This is particularly the case if the flange is improperly formed and is longer than the size of the L-shaped longitudinally extending slot. Also, if the flange is disposed at angle that varies substantially from 90°, it can be difficult to insert in the tool.

Gutter caps made with the Gutter Wizard® tool suffer from variation and distortion in the gutter cap shape that may be caused by bending the forming rolls during the forming process. Distortion is a particular problem with thicker gauge material that may be used to form the gutter cap.

Gutter caps made with the Gutter Wizard® tool are not well suited for retrofit jobs on which gutters are hung at normal gutter height which is about 1.5 inches below the roof edge. The Gutter Wizard® tool has a range of forming motion of only about 175° about a stationary ¾" diameter roller and the blank springs back to a different degree depending upon the thickness and material of the blank. For example, 0.019 aluminum sheet springs back 75° to 100° and 0.027 aluminum sheet springs back 42° to 133°. Typically, more than 2 inches of spacing is required between the top of the gutter and the roof edge which necessitates removing and remounting the gutter for most retrofit jobs.

There is a need for an efficient, all-in-one tool for on-site fabrication of gutter caps. It is important that the tool be easy to use and capable of fabricating gutter caps from standard sheet blanks of different materials and thickness. It is also important that the gutter cap fabrication tool be lightweight and portable for on-site applications.

The above problems and needs are addressed by applicant's invention as summarized below.

SUMMARY OF THE INVENTION

According to one aspect of the present invention, a gutter cap assembly is provided for a roof of a building having a water directing layer, such as shingles, a standing seam metal roof, tile or slate. The roof may have a slanted top surface and a vertically extending face to which a gutter is attached. The assembly comprises a gutter cap having an interstitial planar portion that is received between the top surface of the roof and the water directing layer. A cap portion extends from the interstitial planar portion over and substantially across the top of the gutter. A reversely-turned radiused portion is provided at the opposite end of the cap portion from the interstitial planar portion. The radiused portion is spaced from the gutter to define a gap through which water is directed by surface tension. A return leg extends from the radiused portion below the cap portion. A flange is provided at the opposite end of the return leg from the radiused portion. A plurality of brackets are provided wherein each bracket has an inner end secured to the vertically extending face by a fastener, an intermediate receptacle formed on an upper portion of the bracket to which the anchor flange is secured by at least one retaining lip, and an outer end engaging a lip of the gutter at a spaced location relative to the inner end.

According to other aspects of the invention as they relate to the gutter cap assembly, the gutter cap assembly may include a hook formed on an upper surface of the outer end of the bracket that is hooked behind a hemmed edge of the lip of the gutter. The gutter cap assembly may also have a uniform profile from side to side because the bracket is extruded in a direction perpendicular to a line extending between the inner end and the outer end and is cut to a desired width perpendicular to the direction in which it is extruded. The intermediate portion may define a slot in the flange receiving surface that extends across the flange receiving surface and into the intermediate portion that is adapted to receive a screw that secures the flange to the flange receiving surface.

According still further aspects of the invention, an fastener receptacle is provided between the intermediate portion and the inner wall of the gutter, the fastener receptacle may have an upstanding wall that defines a first hole with the face end defining a second hole, wherein a fastener is installed through the first and second holes to secure the bracket to the face plate. The fastener receptacle, the face end and the upstanding wall in combination with a lower wall define an inner enclosed cell of the bracket. The intermediate portion, the gutter lip engaging end, the lower wall and the upstanding wall in combination define an outer enclosed cell of the bracket. The gutter cap is assembled to a gutter having a facing wall and a gutter lip. The gutter cap has a cap portion, a reversely turned portion, a return leg and a flange. The bracket comprises a lower wall extending from the gutter lip to the facing wall. A flange receiving portion is provided against which the flange is secured when the gutter cap is installed.

According to other aspects of the invention as it relates to bracket structure, a bracket for a gutter cap is provided that has a facing wall, a gutter lip, a cap portion, a reversely-turned portion, a return leg and a flange as described above. The bracket further comprises a lower wall extending generally from the gutter lip engaging end to the face end. An upper wall extends from the gutter lip engaging end to the face end that has an intermediate portion that includes a flange receiving surface. The flange of the gutter cap is secured to the flange receiving surface. A retaining lip disposed adjacent the flange receiving portion to locate the flange of the gutter cap.

According to other aspects of the invention as it relates specifically to the bracket, a hook may be formed on the upper wall at the outer end of the bracket that is hooked into a hem formed on the lip of the gutter. The intermediate portion may define a slot formed in the flange receiving surface that extends across the flange receiving surface in the direction transverse to the length of the bracket. The slot extends into the intermediate portion to receive a screw that secures the flange to the flange receiving surface. The bracket may further comprise a fastener receptacle provided between the intermediate portion and the inner wall of the gutter. The fastener receptacle may have an upstanding wall that defines a first hole with the face end defining a second hole. A fastener is installed through the first and second holes to secure the bracket to the face plate.

The bracket is formed with an inner closed cell that is defined by the fastener receptacle, the face end, the upstanding wall and a lower wall. The bracket is also formed with an outer closed cell that is defined by the intermediate portion, the gutter lip engaging end, the lower wall, the upstanding wall.

The above features and objects of the invention will be better understood in view of the attached drawings and following detailed description of the preferred embodiments.

BRIEF DESCRIPTION OF THE DRAWINGS

FIG. 4 is a fragmentary diagrammatic view showing the bending brake of FIG. 1 forming a flange on a blank;

FIG. 5 is a fragmentary partial side elevation view of a gutter cap forming tool having an integrated flange bender in which the blank has been inserted with phantom lines showing the forming tool after forming a flange on the blank;

FIG. 6 is a fragmentary partial side elevation view showing an alternative embodiment of an integrated flange bender forming the flange on the blank;

FIG. 7 is a fragmentary perspective view showing the blank with the flange inserted in a retainer formed on the gutter cap forming tool housing;

FIG. 8 is a fragmentary side elevation view of the gutter cap forming tool at an initial stage of forming the blank;

FIG. 9 is a fragmentary side elevation view of the gutter cap forming tool at an intermediate stage of forming the blank;

FIG. 10 is a fragmentary side elevation view of the gutter cap forming tool after the forming step is completed;

FIG. 11 is a fragmentary perspective view of a gutter cap made according to one embodiment of the present invention;

FIG. 12 is a fragmentary side elevation view of the gutter cap forming tool illustrating an approach to securing the tool to a bending brake;

FIG. 13 is a perspective view of the gutter cap forming tool and a support stand;

DETAILED DESCRIPTION OF THE PREFERRED EMBODIMENT(S)

Figure 1:
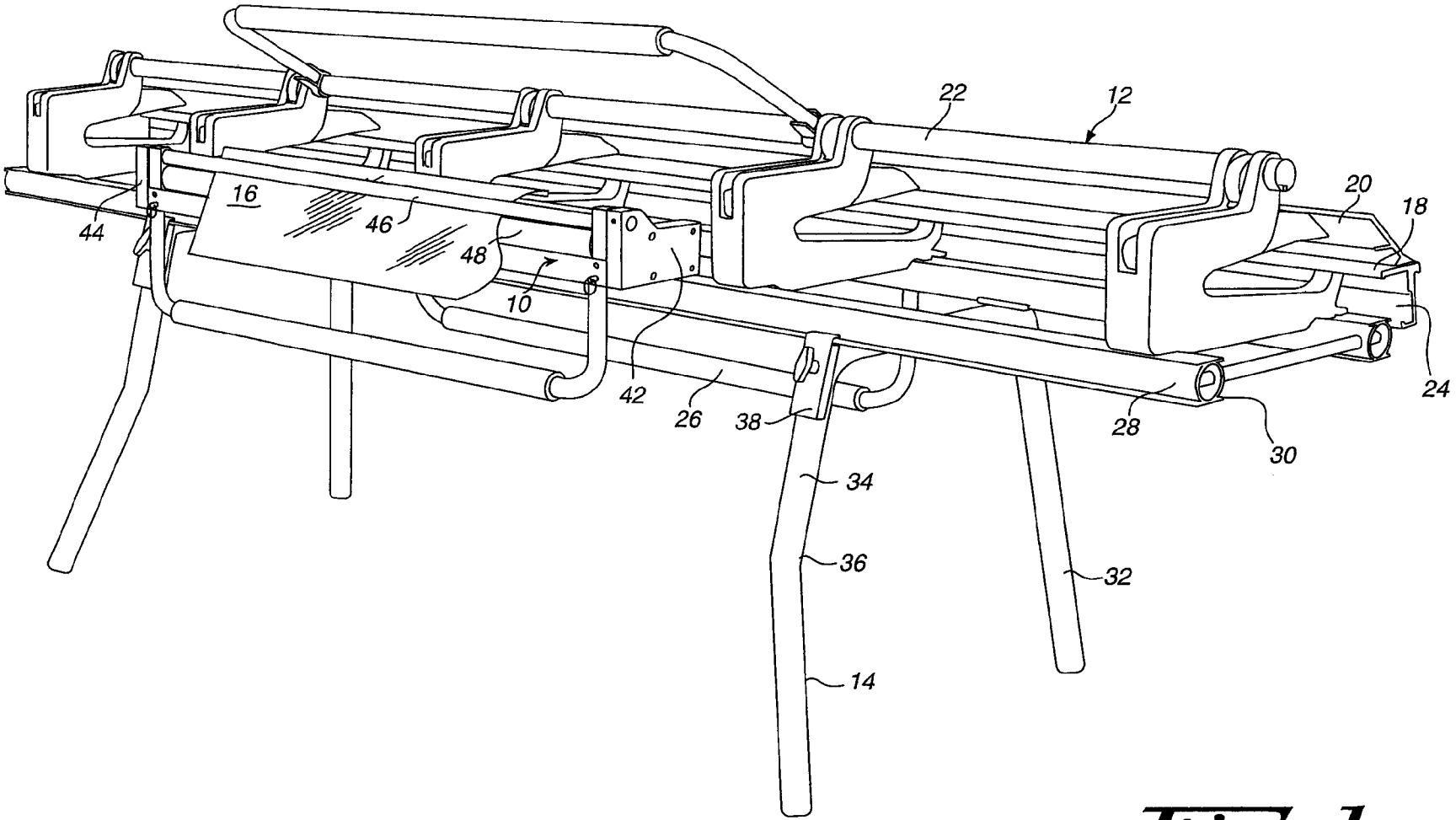
FIG. 1 is a perspective view of a bending brake having a gutter cap forming tool.

Referring to FIG. 1, a gutter cap forming tool 10 is shown attached to a sheet metal bending brake 12. The forming tool 10 and brake 12 are supported by a stand 14. A sheet stock blank 16 is shown inserted in the forming tool 10. The sheet stock blank 16 could be aluminum, steel, copper or expanded metal. The blank 16 could be provided in any color to match siding or gutter color and may be provided in a wide range of commercially available sheet stock thicknesses.

The bending brake 12 may be a commercial portable bending brake such as bending brakes sold by Van Mark Products, assignee of this application, and identified by the model designations Mark I Series, Mark II Trim Master®, Mark IV Trim Master®, or Trim-A-Brake II. The bending brake 12 includes an anvil 18 and a clamp 20 in which a blank 16 may be inserted and locked in place by turning the cam lock bar 22. A bending leaf 24 is lifted by a handle 26 to engage the blank 16 and forming a bend in the blank 16. The bending brake 12 is supported on a pair of rails 28 that include rail flanges to which the bending brake 12 is secured.

The stand 14 includes a pair of front legs 32 and a pair of rear legs 34. Rear legs 34 include a bend 36 that directs the rear legs 34 outwardly to stabilize the stand. A clamp bracket 38 secures the rear legs 34 to a rail flange 30 of one of the rail 28. Other brackets (not shown) are also provided on the front legs 32 to secure the front legs to one of the rails 28.

The forming tool 10 includes a right roll support 42 and a left roll support 44 that supports opposite ends of a fixed roll 46. An arcuately moveable forming roll 48 is used to form the blank 16 in conjunction with fixed roll 46 as is more particularly described below with reference to FIGS. 2, 3 and 7-10.

Figure 2:
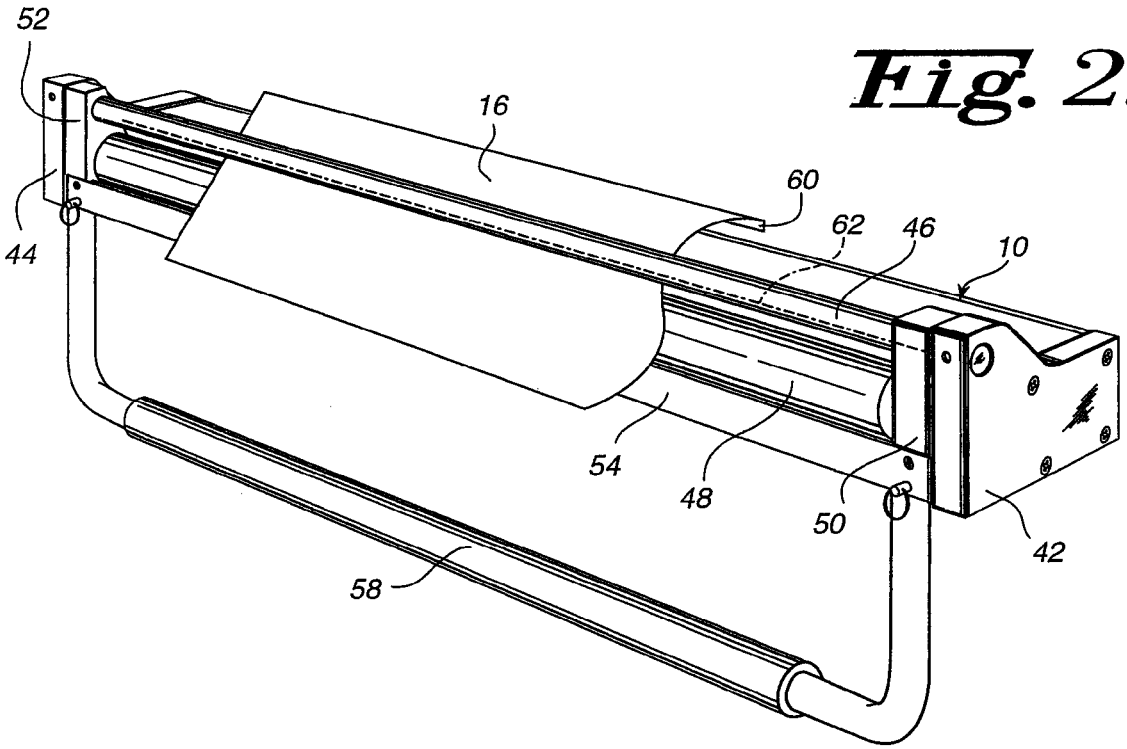
FIG. 2 is a perspective view of a gutter cap forming tool.
Figure 3:
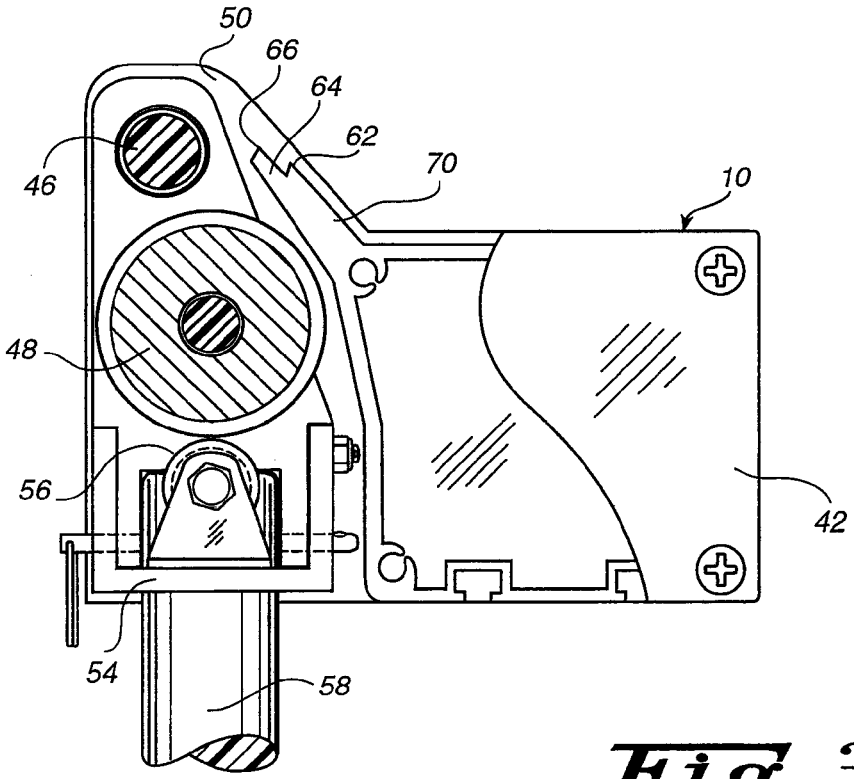
FIG. 3 is a fragmentary partial side elevation view of the gutter cap forming tool shown in FIG. 2.

Referring to FIGS. 2 and 3, gutter cap forming tool 10 is shown in isolation. A blank 16 is inserted between fixed roll 46 and arcuately moveable forming roll 48. The fixed roll 46 and forming roll 48 are received between right pivot support 50 and left pivot support 52. A support brace 54 extends between the supports 50, 52 and adjacent to the forming roll 48. As best seen in FIG. 3, an anti-deflection roller 56 may be incorporated as part of the support brace 54. The anti-deflection roller 56 is adapted to roll along the surface of the forming roll 48 as it forms the blank 16 around the fixed roll 46. Anti-deflection roller 56 allows the forming roll 48 to rotate while preventing the forming roll 48 from deflecting away from the fixed roll 46. A handle 58 is attached to the pivot supports 50, 52 and support brace 54 to provide a convenient gripping point and leverage for forming the blank 16 as the forming roll 48 is moved about the fixed roll 46.

As shown in FIG. 2, the blank 16 has a flange 60 that was previously formed in a bending brake. The flange 60 is received by a retaining lip 62. The flange 60 may be moved in a direction normal to the retaining lip 62 and remains seated on the lip 62 throughout the forming process.

Referring to FIG. 4, the step of forming a flange 60 on the blank 16 is illustrated with reference to a bending brake 12. The blank 16 is initially inserted between the clamp 20 and anvil 18. While the clamp 20 and anvil 18 securely hold the blank, bending leaf 24 is lifted to form a brake, or bend, in the blank 16 as shown. The flange 60 and blank 16 may be bent to a perpendicular relationship as shown in FIG. 4.

Referring to FIGS. 5 and 6, two embodiments of an integrated flange bender are illustrated that may be provided as part of the gutter cap forming tool 10. In each embodiment a receptacle for an edge of the blank is provided to form a ½ inch flange on the blank. The orientation of the receptacle also facilitates forming the flange to the desired angular relationship of about 90°.

In FIG. 5, the integrated flange bender 72 comprises a bending leaf 74 that is pivotally attached to the forming tool 10. The bending leaf 74 has a handle 76 that is used to manipulate the bending leaf 74. The bending leaf 74 also includes a slot 78 that is adapted to receive a fixed length of the blank 16. To form a flange 60, the bending leaf 74 is moved from the position shown in sold lines in FIG. 5 to the position shown in phantom lines in FIG. 5. After forming, the bending leaf 74 may be returned to the position shown in solid lines in FIG. 5 and the blank 16 with its flange 60 may be removed from the flange bender 72 and inserted between the rolls 46 and 48 and formed as will be described below with reference to FIGS. 7-10.

Referring to FIG. 6, an alternative embodiment of an integrated flange bender and gutter cap forming tool 80 is illustrated. The tool 80 is substantially similar to the embodiment of FIG. 3, but also includes a flange bender 82 comprising a slot 84 formed in the tool 80, that is adapted to receive an edge 86 of the blank 16. The support brace 54 is moved by the handle 58 to engage the blank 16 and form a flange 60 on the blank 16.

Referring to FIGS. 7-10, the forming tool 10 is shown in a series of steps of the gutter cap forming process. Referring specifically to FIG. 7, the forming tool 10 is shown as it would appear with the blank 16 and its associated flange 60 loaded into the tool 10. Flange 60 is held by the retaining lip 62. The remainder of the blank 16 extends between the fixed roll 46 and the moveable roll 48. An anti-deflection die 87 is shown as it is attached to the tool 10. The anti-deflection die 87 comprises a first leg 87*a* that is secured by a fastener to the tool and a second leg 87*b* that is received in a slot 89 in the fixed roll 46.

In FIG. 8, an arcuate bend 88 is shown as it initially begins to form. In the initial stage of the forming operation, the handle 58 lifts the moveable roll 48 and the support brace 54 in an arcuate path around the fixed roll 46. In FIG. 9, the handle 58 has been used to lift the moveable roller 48 and move it arcuately about the fixed roll 46. The arcuate bend 88 is formed to a greater extent as shown in FIG. 9.

In FIG. 10, the blank 16 is shown with its fully formed arcuate bend 88. The tool is designed to allow the moveable roll to move in an arc of more than 180° around the stationary roll to bend a portion of the blank into the reversely-turned portion of the gutter cap. The moveable roll may be moved in an arc of more than 200° around the stationary roll to obtain a tighter bend in the gutter cap. While the blank is formed to more than 180°, or to about 200°, depending upon the material and thickness of the blank, it will spring back. If the blank is formed around the fixed roll of 200°, the blank will spring back to provide a 180° to 195° bend in the blank.

Referring to FIG. 11, a gutter cap 90 is shown to include a cap portion 94 that extends over the gutter. The cap portion 94 overlies the flange 60 that was initially formed by the bending brake 12 or a flange bender as described with reference to FIGS. 5 and 6. A reversely turned arcuate bend 96 is provided between the cap portion 94 and a return leg 97. The return leg 97 is disposed between the arcuate bend 96 and the flange 60.

Referring to FIG. 12, the forming tool 10 is shown in a position where it is ready to be attached to a conventional bending brake 12. The forming tool 10, as illustrated, may have a bracket 95 that secures the tool 10 to the bending brake 12. A nut is retained in a receptacle 96 for receiving a fastener 98 that attaches the bracket 95 to the tool 10.

Referring to FIG. 13, a gutter cap forming tool 10 is shown attached to an alternative embodiment of a stand 99. The gutter cap forming tool 10 may be provided as a stand alone tool with its own stand or may be provided in conjunction with a bending brake 12, as shown in FIG. 1. The forming tool 10 is shown with a blank 16 inserted between the fixed roll 46 and the arcuately moveable forming roll 48. The forming roll 48 is lifted manually by means of a handle 58 as previously described to form the gutter cap.

Figure 14:
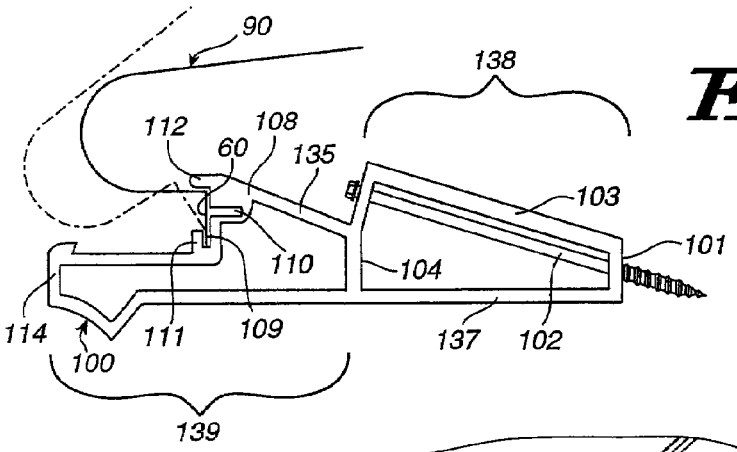
FIG. 14 is a side elevation view of one embodiment of a bracket that is used to attach the gutter cap.

Referring to FIG. 14, a bracket 100 is shown that may be formed by molding or extruding. The bracket 100 could be formed as an aluminum extrusion, but could also be formed of a different metal or of a rigid or reinforced molded resin. The bracket 100 may be formed as an extrusion having a relatively long length that is then cut into individual brackets by cutting the extruded member perpendicular to the extrusion direction. The bracket 100 may also be formed in an injection molding process as a discrete molded part.

The bracket 100 includes a face engaging end 101 and is held in place by means of a wood screw 102. The bracket 100 includes a fastener receptacle 103 that receives the wood screw 102. An intermediate, or upstanding, wall 104 defines a first hole 105 and the face engaging end 101 defines a second hole 106. The wood screw, or nail, 102 is inserted through the first and second holes 105, 106 to attach the bracket 100 to a face plate 107, or fascia, of a building.

An intermediate portion 108 of the bracket 100 is provided that has a flange receiving surface 109 that defines a slot 110. A lower retaining lip 111 and an upper retaining lip 112 may be provided to locate the flange 60 of the gutter cap 90 on the flange receiving surface 108. The lower retaining lip 111 and the upper retaining lip 112 may together or individually hold the flange 60 of the gutter cap 90. The slot 110 is adapted to receive a self-tapping screw 113 (shown in FIG. 16) in a range of lateral locations without requiring precise alignment of the self-tapping screw 113 with a small hole. A gutter lip engaging end 114 is provided on the opposite end of the bracket 100 from the face engaging end 101.

Figure 15:
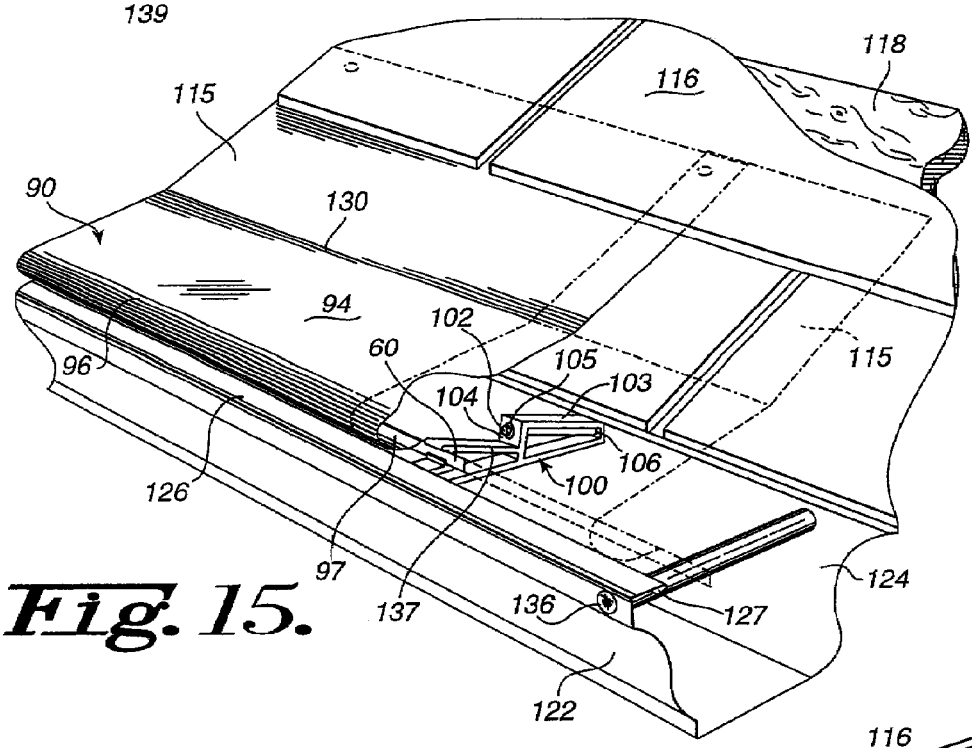
FIG. 15 is a fragmentary perspective view of the gutter cap and the bracket assembled to a building and a gutter.
Figure 16:
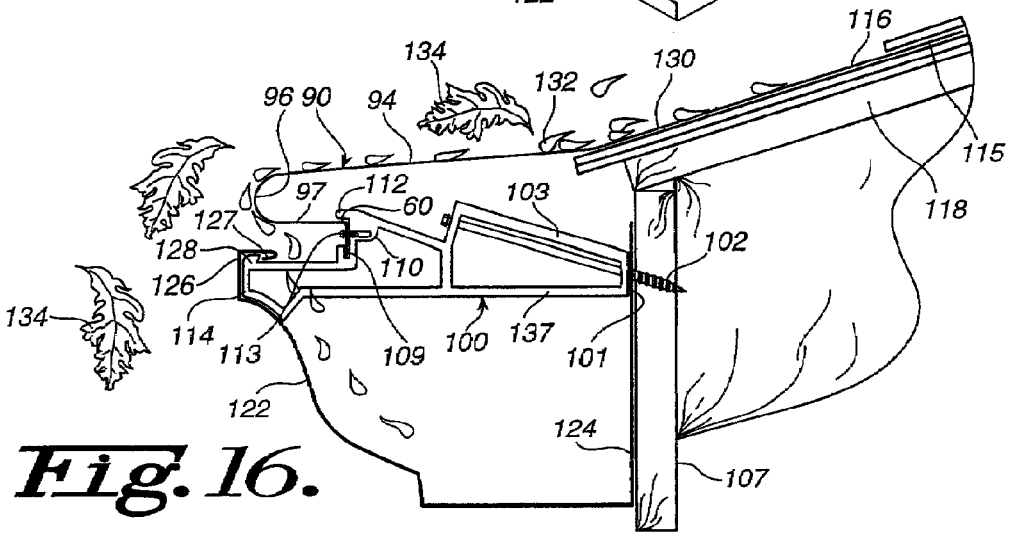
FIG. 16 is a diagrammatic side elevation view of the gutter cap secured to the building with the bracket assembled to the gutter.

Referring to FIGS. 15 and 16, installation of the gutter cap 90 is described in greater detail. An interstitial planar portion 115 of the gutter cap 90 is inserted between a layer of roofing material 116, such as a layer of shingles, standing seam metal roof, shake shingle, tile or slate roof. The interstitial planar portion 115 is placed between the layer of roofing material 116 and the roof structure 118. The roof structure 118 also includes the face plate 107 onto which a gutter 122 is installed. An inner wall 124 of the gutter 122 is secured to the face plate 107. A gutter lip 126 is provided on the opposite side of the gutter from the inner wall 124. The gutter lip engaging end 114 of the bracket 100 may be twisted to secure the bracket 100 within the gutter lip 126. A hem 127 is formed on the gutter lip 126 that is hooked by a hook 128 that is formed on an upper surface of the gutter engaging, or outer, end 114 of the bracket 100. The cap portion 94 of the gutter cap 90 extends above the gutter 122 and terminates in the reversely-turned arcuate bend 96. A transition break 130 may be provided between an interstitial portion 115 and the cap portion 94. Rain water flowing down the layer of roofing material 116 slows upon reaching the transition break 130 causing the water to pool and flow more slowly across the cap portion 94. Upon reaching the reversely-turned arcuate bend 96, water 132 flows around the arcuate bend 96 and across the return leg 97 by reason of surface tension until the water 132 contacts the flange 60, at which point the water is directed into the gutter 122. Leaves 134 are shed from the gutter cap 90 that covers the gutter 122. In the illustrated embodiment, the gutter 122 is attached by gutter spikes 136. Gutter spikes 136 are used to nail the gutter 122 to the face plate 107 to secure the gutter 122 to the building.

The gutter 122 may be a new installation or may have been previously installed on the building and the gutter cap 90 may be provided as a retrofit. The face engaging end 101 is located against the inner wall 124 of the gutter 122. The bracket 100 is secured in place by the wood screw 102 that is inserted through the first and second holes 105, 106 formed in the receptacle 103. After the bracket 100 is installed, interstitial portion 115 of the gutter cap 90 is inserted underneath the roofing material 116. The flange 60 may then be secured to the bracket 100 by the self-tapping screw 113 that is received in the extruded slot 110.

The bracket 100 has a lower wall 137 that extends from the gutter lip 126 to the inner wall 124. An upper wall 135 is disposed above the lower wall 137 and is coextensive therewith. The upper wall 135 defines the fastener receptacle 103 and the intermediate portion 108. An inner closed cell 138 is defined by the fastener receptacle 103, the face engaging end 101, the intermediate wall 104 and the lower wall 137. An outer closed cell 139 is defined by the intermediate portion 108, the gutter lip engaging end 114, the lower wall 137 and the intermediate wall 104.

Figure 17:
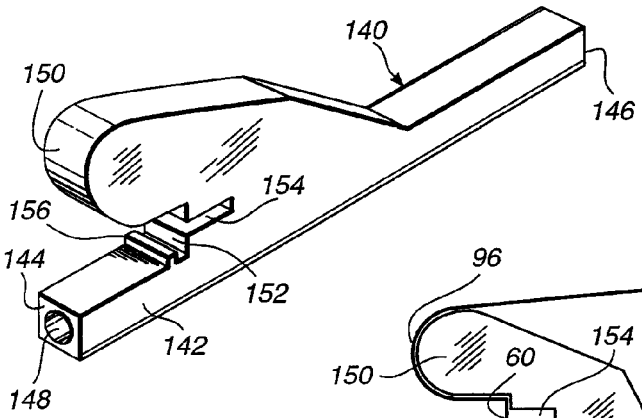
FIG. 17 is a perspective view of another embodiment of a bracket.
Figure 18:
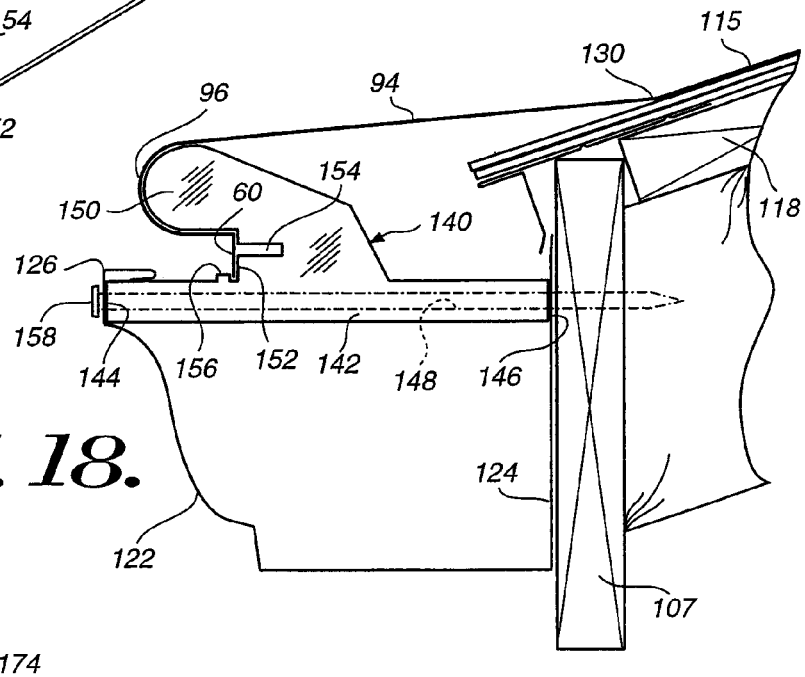
FIG. 18 is a diagrammatic side elevation view of the gutter cap secured to the building with the bracket of FIG. 17.

Referring now to FIGS. 17 and 18, an alternative embodiment of a gutter cap bracket is generally referred to by reference 140. The bracket 140 includes a lower wall 142 that extends from a lip end 144 to a face end 146. Lip end 144 is adapted to engage the gutter lip 126. The face end 146 engages the inner wall 124 of the gutter 122. A bore 148 extends from the lip end 144 to the face end 146. A bulbous nose portion 150 extends from an intermediate point on the lower wall 142 upwardly and toward the lip end 144. The bulbous nose 150 is curved to correspond to the desired curvature of the reversely-turned arcuate bend 96 of the gutter cap 90. The nose 150 is intended to support the arcuate bend 96. A flange receiving surface 152 is provided below the nose 150 that is adapted to receive the flange 60 of the gutter cap 90. A slot 154 is provided in flange receiving surface 152. Slot 154 is adapted to receive a screw, like screw 113 shown in FIG. 16. This screw 113 may be received at any point in the slot 154 provided that the screw 104 is able to grip the edges of the slot 154. A lip 156 is provided between the flange receiving surface 152 and the lip end 144 of the bracket 140. Lip 156 is provided to retain the flange 60 against the flange receiving surface 152. The flange 60 is snapped over the lip 156 when the gutter cap 90 is assembled to the bracket 140. A nail 158 that can be a conventional gutter spike may be inserted through the gutter lip 126 and the bore 148 formed in the lower wall 142 of the bracket 140. The nail 158 is driven through the inner wall 124 of the gutter 122 and secured to the face plate 107 of the building on which the gutter 122 is installed. One advantage of this embodiment of a gutter cap bracket is that gutter spikes that are normally used to retain the gutter on a building may be accommodated by the bracket 140. This reduces the number of parts and eliminates concerns regarding adapting the gutter cap to previously installed gutter spikes.

Figure 19:
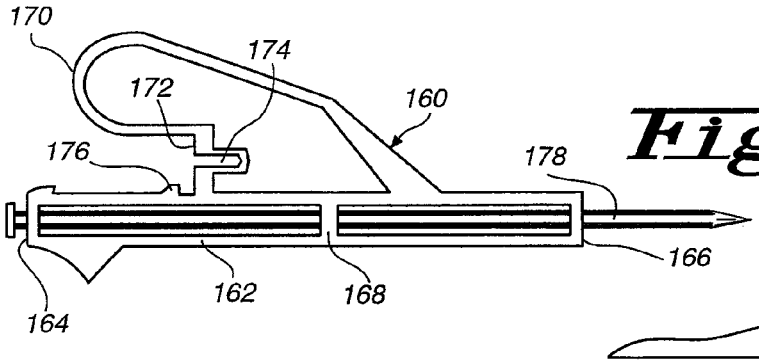
FIG. 19 is a side elevation view of another embodiment of a bracket.

Referring to FIG. 19, another alternative bracket 160 is illustrated that may be formed as an extrusion. Bracket 160 differs from bracket 140 in that it is a substantially hollow member that requires less material to form the bracket. The bracket 160 has a lower wall 162 that extends from a lip end 164 to a face end 166. An intermediate wall 168 is provided between lip end 164 and face end 166. A bulbous nose portion 170 is provided above the lower wall 162 and near the lip end 164 of the bracket 160. A flange receiving surface 172 is provided below the nose 170. Flange receiving surface 172 is adapted to receive the flange 60 of the gutter cap 90. A slot 174 is provided in the flange receiving surface 172. Slot 174 is intended to receive a self-tapping screw (not shown) to attach flange 60 to the flange receiving surface 172. A lip 176 is provided between the flange receiving surface 172 and the lip end 164. When the gutter cap 90 is installed, the flange 60 is snapped over the lip 176 to hold the flange near the flange receiving surface 172. A nail 178 is inserted through holes (not shown) in the lip end 164, face end 166 and intermediate wall 168 of the lower wall 162 of the bracket 160. The nail 178 is a conventional gutter spike that is used to secure the gutter and gutter cap bracket to the face plate 107 of a building.

Figure 20:
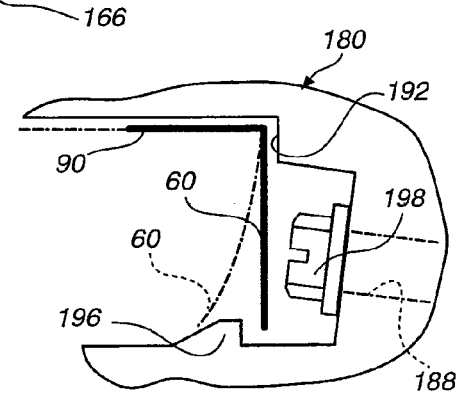
FIG. 20 is a side elevation view of another embodiment of a bracket.
Figure 21:
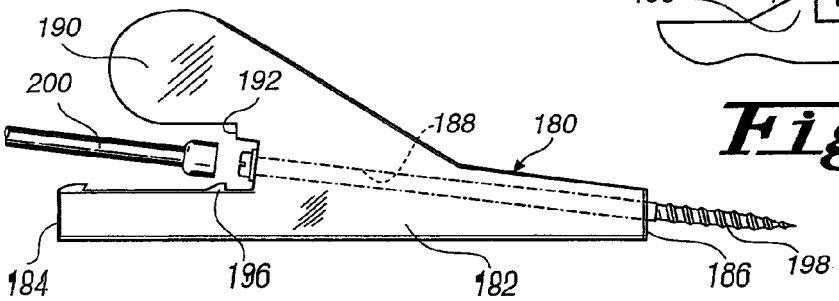
FIG. 21 is a fragmentary close-up side elevation view of a portion of the bracket shown in FIG. 20.

Referring to FIGS. 20 and 21, another alternative embodiment of a gutter cap bracket is generally referred to by reference numeral 180. Bracket 180 includes a lower wall 182 that extends from a lip end 184 to a face end 186. A bore 188 is provided partially on the lower wall 182. A nose 190 is formed above the lower wall 182 and extends toward the lip end 184. The nose 190 is provided to support the reversely-turned arcuate bend 96 of the gutter cap 90. A flange receiving surface 192 is provided below the nose 190. A lip 196 is provided between the flange receiving surface 192 and the lip end 184 of the bracket 180. A wood screw 198 may be secured through the bore 188 that extends from the flange receiving surface 192 to the face end 186 of the bracket 180. The wood screw 198 may be driven by a screwdriver or nut running tool 200 to secure the bracket 180 to the face plate 107 of a building. The bracket 180 is preferably installed on the building before attachment of the gutter cap to the bracket.

The bracket 100 is mounted to the gutter 122 and then to the face plate 107, or fascia, with the wood screw 102, or other fastener, that is inserted through first and second holes 105, 106 formed in the fastener receptacle 103 of the bracket 100. The flange 60 is retained between lower retaining lip 111 and upper retaining lip 112. The cap 90 may then be rotated towards the roof from the position shown as a phantom line to the position shown as a solid line in FIG. 14. The end of the gutter cap 90 may then be inserted under the first or second courses of shingles. The cap 90 may then be nailed in place under the shingles. Alternatively, the bracket 100 could be secured in place by the wood screw 102, or other fastener, as previously described through the hole formed in the bracket 100. After the bracket 100 is installed, the gutter cap 90 may be inserted under the roofing layer 116 and the flange 60 may then be secured to the bracket 100 by the upper and lower retaining lips 111, 112 and, if desired, by the self-tapping screw 113 that is received in the extruded slot 110.

It should be understood that the brackets and gutter cap could be installed as new construction or as a retrofit. As noted previously, prior art systems generally require that the gutter be removed and lowered to provide proper water flow across the gutter cap.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A gutter cap assembly for a roof of a building having a water directing layer, the roof having a slanted top surface and a vertically extending face plate to which a gutter is attached, the assembly comprising:

a gutter cap having:

an interstitial planar portion that is received between the top surface and the water directing layer;

a cap portion that extends from the interstitial planar portion over and substantially across the gutter;

a reversely-turned radiused portion at the opposite end of the cap portion from the interstitial planar portion, the radiused portion being spaced from the gutter to define a gap through which water is directed by surface tension;

a return leg extending from the radiused portion below the cap portion and above the gutter;

a flange at the opposite end of the return leg from the radiused portion;

a plurality of brackets wherein each bracket has:

an inner end secured to the vertically extending face by a fastener;

an outer end engaging a lip of the gutter that is spaced from the inner end; and an intermediate portion formed on an upper portion of the bracket, a flange receiving surface provided on the intermediate portion having:

a touching relationship parallel with the flange;

at least one retaining lip disposed adjacent the flange receiving surface that constrains the flange; and a slot that extends into the intermediate portion.

2. The gutter cap assembly of claim 1 further comprising a hook formed on an upper surface of the outer end of the bracket that is hooked behind a hemmed edge of the lip of the gutter.

3. The gutter cap assembly of claim 1 wherein the bracket has a uniform profile from side to side because the bracket is extruded in a direction perpendicular to a line extending between the inner end and the outer end and is cut to a desired width perpendicular to the direction in which it is extruded.

4. The gutter cap assembly of claim 3 wherein the slot extends across the flange receiving surface and receives a screw that secures the flange to the flange receiving surface.

5. The gutter cap assembly of claim 1 further comprising a fastener receptacle provided between the intermediate portion and the inner wall of the gutter, the fastener receptacle having an upstanding wall that defines a first hole and wherein the face end defines a second hole, wherein a fastener is installed through the first and second holes to secure the bracket to the face plate.

6. The gutter cap assembly of claim 5 wherein the fastener receptacle, the face end and the upstanding wall in combination with a lower wall define an inner enclosed cell of the bracket.

7. The gutter cap assembly of claim 6 wherein the intermediate portion, the gutter lip engaging end, the lower wall and the upstanding wall in combination define an outer enclosed cell of the bracket.

8. A bracket for a gutter cap that is assembled to a gutter having an inner wall and a gutter lip, the gutter cap has a cap portion, a reversely turned portion, a return leg and a flange, wherein the bracket comprises:

a lower wall extending from the gutter lip engaging end to a face end;

an upper wall extending from the gutter lip engaging end to the face end that has an intermediate portion that includes a flange receiving surface, the flange receiving surface having a touching relationship parallel with the flange, wherein the flange of the gutter cap is secured to the flange receiving surface; and at least one retaining lip disposed adjacent the flange receiving portion that locates the flange of the gutter cap.

9. The bracket for a gutter cap of claim 8 further comprising a hook formed on the upper wall at the outer end of the bracket that is hooked into the lip of the gutter.

10. The bracket for a gutter cap of claim 8 wherein the intermediate portion defines a slot formed in the flange receiving surface that extends across the flange receiving surface and into the intermediate portion that receives a screw that secures the flange to the flange receiving surface.

11. The bracket for a gutter cap of claim 8 further comprising a fastener receptacle that is provided between the intermediate portion and the inner wall of the gutter, the fastener receptacle having an upstanding wall that defines a first hole and wherein the face end defines a second hole, wherein a fastener is installed through the first and second holes to secure the bracket to the face plate.

12. The gutter cap assembly of claim 11 wherein the fastener receptacle, the face end and the upstanding wall in combination with a lower wall define an inner closed cell of the bracket.

13. The gutter cap assembly of claim 12 wherein the intermediate portion, the gutter lip engaging end, the lower wall and the upstanding wall in combination define an outer closed cell of the bracket.

14. A gutter cap assembly for a roof of a building having a water directing layer, the roof having a slanted top surface and a vertically extending face plate to which a gutter is attached, the assembly comprising:

a gutter cap having:

an interstitial planar portion that is received between the top surface and the water directing layer;

a cap portion that extends from the interstitial planar portion over and substantially across the gutter;

a reversely-turned radiused portion at the opposite end of the cap portion from the interstitial planar portion, the radiused portion being spaced from the gutter to define a gap through which water is directed by surface tension;

a return leg extending from the radiused portion below the cap portion and above the gutter;

an end flange at the opposite end of the return leg from the radiused portion;

a plurality of brackets wherein each bracket has:

an inner end secured to the vertically extending face by a fastener;

an outer end engaging a lip of the gutter that is spaced from the inner end;

an intermediate portion formed on an upper portion of the bracket; and means for securing the end flange to the intermediate portion.

* * * * *